US008528479B2

(12) United States Patent
Clayton

(10) Patent No.: US 8,528,479 B2
(45) Date of Patent: Sep. 10, 2013

(54) DEFEAT DEVICE FOR DEFEATING IMPROVISED EXPLOSIVE DEVICE HAVING A WIRE INITIATION SYSTEM

(76) Inventor: Cory Clayton, Randleman, NC (US)

( * ) Notice: Subject to any disclaimer, the term of this patent is extended or adjusted under 35 U.S.C. 154(b) by 22 days.

(21) Appl. No.: 13/164,607

(22) Filed: Jun. 20, 2011

(65) Prior Publication Data

US 2012/0318160 A1 Dec. 20, 2012

(51) Int. Cl.
*B63G 7/04* (2006.01)

(52) U.S. Cl.
USPC ..... 102/402; 89/1.13

(58) Field of Classification Search
USPC ..... 89/1.13, 1.11, 1.1; 102/401–403, 102/427–428; 172/197, 239; 248/605
See application file for complete search history.

(56) References Cited

U.S. PATENT DOCUMENTS

| | | | | | |
|---|---|---|---|---|---|
| 2,409,635 | A * | 10/1946 | Langner | 89/1.13 |
| 2,425,357 | A * | 8/1947 | Walker | 89/1.13 |
| 2,953,336 | A * | 9/1960 | Etchells | 248/605 |
| 3,771,413 | A * | 11/1973 | Sieg et al. | 89/1.13 |
| 4,967,850 | A * | 11/1990 | Bargfrede et al. | 172/197 |
| 5,046,565 | A * | 9/1991 | Purcell | 172/239 |
| 5,189,243 | A * | 2/1993 | Hambric | 89/1.13 |
| 6,892,622 | B2 * | 5/2005 | Watson | 89/1.13 |
| 2004/0028469 | A1 * | 2/2004 | Dehart | 404/6 |

* cited by examiner

*Primary Examiner* — Stephen M Johnson
*Assistant Examiner* — John D Cooper
(74) *Attorney, Agent, or Firm* — Roylance, Abrams, Berdo & Goodman, L.L.P.

(57) ABSTRACT

A device for defeating an improvised explosive device having a wire initiation system includes at least one coil of a barbed wire. A connecting member connects at least one coil of the barbed wire to a support. The connecting member is disposed such that at least one coil of the barbed wire contacts the ground. Movement of the at least one coil of the barbed wire across the ground engages a wire of the wire initiation system to defeat the improvised explosive device.

22 Claims, 11 Drawing Sheets

DEFEAT DEVICE FOR DEFEATING IMPROVISED EXPLOSIVE DEVICE HAVING A WIRE INITIATION SYSTEM

This invention was made at least in part with government support during active duty. The government has certain rights in the invention.

FIELD OF THE INVENTION

The present invention relates generally to a device to detect, disarm and otherwise defeat the concealed wire detonation initiation systems that are used by insurgents to detonate improvised explosive devices (IEDs) along roadways near unsuspecting soldiers. More particularly, the present invention relates to an easily maneuverable defeat device that is mounted on the front of a vehicle. Still more particularly, the present invention relates to a defeat device that detects, disarms and defeats an IED having a concealed wire initiation system without detonating the IED.

BACKGROUND OF THE INVENTION

An Improvised Explosive Device (IED) generally includes an explosive charge, a detonator and an initiation system all of which are concealed from view by soldiers in a moving vehicle. The initiation system for the IED is the mechanism that initiates the electrical charge that sets off the detonator, which in turn, causes the explosive charge to explode.

Typical initiation systems include what are known as "crush" wire and "trip" wire systems. These triggers are readily concealed and generally include some combination of pressure plates, trip wires extended across a road or trail and systems based on spaced apart wires that close an electrical contact when closed or crushed together as when a vehicle rolls over the spaced apart wires.

An example of a typical crush wire system is shown in FIG. 1 with IED 11 and crush wire initiation system 13. Two wire conductors 14 and 15, such as copper wire, are connected to a blasting cap 16. The wire conductors 14 and 15 are separated by a distance x. Typically, the wire conductors 14 and 15 are spaced about a ¼ inch apart. A battery 17 is mechanically and electrically connected to one of the wire conductors. A plurality of flexible tubing 18, such as plastic tubing, is spaced along the wire initiation system 13. The wire conductors 14 and 15 pass through the flexible tubing 18. A pair of contacts 19 and 20, such as metal strips, are connected to each flexible tubing 18. Each contact 19 and 20 is connected to one of the wire conductors 14 and 15. The plastic tubing assemblies are separated by a distance y, holding the circuit open and spaced about six inches apart or about the width of one vehicle tire. Such a close distance makes it unlikely that a vehicle would not compress the tubing assemblies and cause the IED to detonate.

The blasting cap 16 is connected to an explosive charge 21. The crush wire initiation system 13 has a length identified as the distance z, which is typically about fifteen feet long to stretch across a roadway 10. The wire conductors 14 and 15 are disposed substantially perpendicular to a direction of travel along the roadway 10. The tubing assembly is often made of a sufficiently thick material that the circuit remains open even if the crush wire system is covered by a concealing layer of soil, sand or small rocks. The flexible tubing 18 maintains separation between the contacts 19 and 20 until tubing 18 is compressed from vehicle tires.

Crush wire initiation system is extremely difficult to detect, particularly from within a moving vehicle. As noted above, a concealing layer of soil can cover the device yet allow it to operate without hindrance. Additionally, the wire initiation system 13 allows the blasting cap 16 and explosive 21 to remain hidden off of either side 8 or 9 of the roadway 10, as shown in FIG. 1. When a tire of a vehicle contacts one of the flexible tubing assemblies, the flexible tubing 18 is crushed. This brings the two contacts 19 and 20 into contact, thereby closing the electrical circuit. The battery 17, which is the power source for the circuit, supplies an electrical current that is then carried through the wire conductors 14 and 15 to the sensitive explosive of the blasting cap 16, thereby detonating the blasting cap. The detonation of the blasting cap 16 causes the less sensitive, but more powerful, explosive 21 to detonate.

One device currently used to combat IEDs is a roller system that is attached to the front of a vehicle. One existing roller system is the Self-Protection Adaptive Roller Kit (SPARK) System. One of the drawbacks associated with the roller system is that it detonates the IED. Although the roller system is mounted in front of the vehicle, detonating an IED still poses a danger to the vehicle and personnel. The roller system is typically destroyed when it detonates an IED. This requires either the roller system to be replaced or a new vehicle with a new roller system to be provided, which is expensive and time consuming. Moreover, detonation of an IED alerts the enemy to the unit's presence in the area, thereby subjecting the unit to observation and possible ambush. Because the roller system detonates the IED, the IED device cannot be recovered and studied, thereby preventing the recovery of valuable information from an intact IED. Additionally, the roller systems are heavy and unwieldy that are not easily connected to, or disconnected from, the vehicle.

Another device currently used to combat IEDs is a chain and hook system that is connected to a roller system. However, as the chain and hook system is used in conjunction with a roller system, the chain and hook system suffers from the same deficiencies.

Yet another device currently used to combat IED's is an infrared detection system. However, these systems only detect IED's that utilize infrared light beams as the initiation system. Accordingly, they are not effective in detecting and defeating IEDs using crush wire initiation systems.

Accordingly, a need exists for a portable or mobile device that can be used to detect, disarm and otherwise defeat the surprise and concealment capabilities of crush wire initiated, IED explosives, preferably without detonating the associated IED or initiation system.

SUMMARY OF THE INVENTION

In accordance with an aspect of the present invention, a mobile defeat device uncovers, disarms and/or otherwise renders safe IEDs that are initiated with concealable, crush wire systems without detonating the IED.

In accordance with another aspect of the present invention, a defeat device for crush wire IEDs is easily connected to a mobile support.

In accordance with another aspect of the present invention, a defeat device is provided that is easily replaceable if damaged using equipment that is readily available in a secured facility or encampment.

The foregoing objectives are obtained by a crush wire defeat device that includes a lightweight removal member suitable for ground contact in a relatively shallow furrowing action, such as at least one coil of a barbed wire, that is mounted on a pivotable, extendable support and which extends from a mobile vehicle. A connecting member connects the removal member to a support and is disposed such that the removal member can be pivoted into contact with the ground in front and/or on either side of the vehicle. As the removal member drags across the ground with its furrowing action, it will burrow below any shallow layer of concealing material and engage the wire initiation system with a lifting action that will reveal the device. Forward motion of the vehicle will exert tension on the engaged initiation system and pull the wire and/or blasting cap from the associated explosive device that may be concealed alongside the roadway. This discovery and/or disarming action defeats the concealed IED and its initiation system while also rendering both safe for later inspection.

The foregoing objectives are also obtained by a method of defeating an improvised explosive device having a crush wire initiation system. The method comprises dragging a lightweight removal member that is suitable for ground contact across the ground in front and/or to the sides of a moving vehicle whereby the removal member can burrow below a shallow layer of concealing material and engage a crush wire initiation system without closing the electrical contacts of the initiation system and with the capability of removing the wire and/or blasting cap of the IED by continued movement of the removal member in contact with a wire of the wire initiation system.

Objects, advantages, and salient features of the invention will become apparent from the following detailed description, which, taken in conjunction with the annexed drawings, discloses exemplary embodiments of the invention.

As used in this application, the terms "front," "rear," "upper," "lower," "upwardly," "downwardly," and other orientational descriptors are intended to facilitate the description of the exemplary embodiments of the present invention, and are not intended to limit the structure thereof to any particular position or orientation.

BRIEF DESCRIPTION OF THE DRAWINGS

The above benefits and other advantages of the various embodiments of the present invention will be more apparent from the following detailed description of exemplary embodiments of the present invention and from the accompanying figures, in which.

Throughout the drawings, like reference numbers will be understood to refer to like parts, components and structures.

DETAILED DESCRIPTION OF EXEMPLARY EMBODIMENTS

Figure 1:
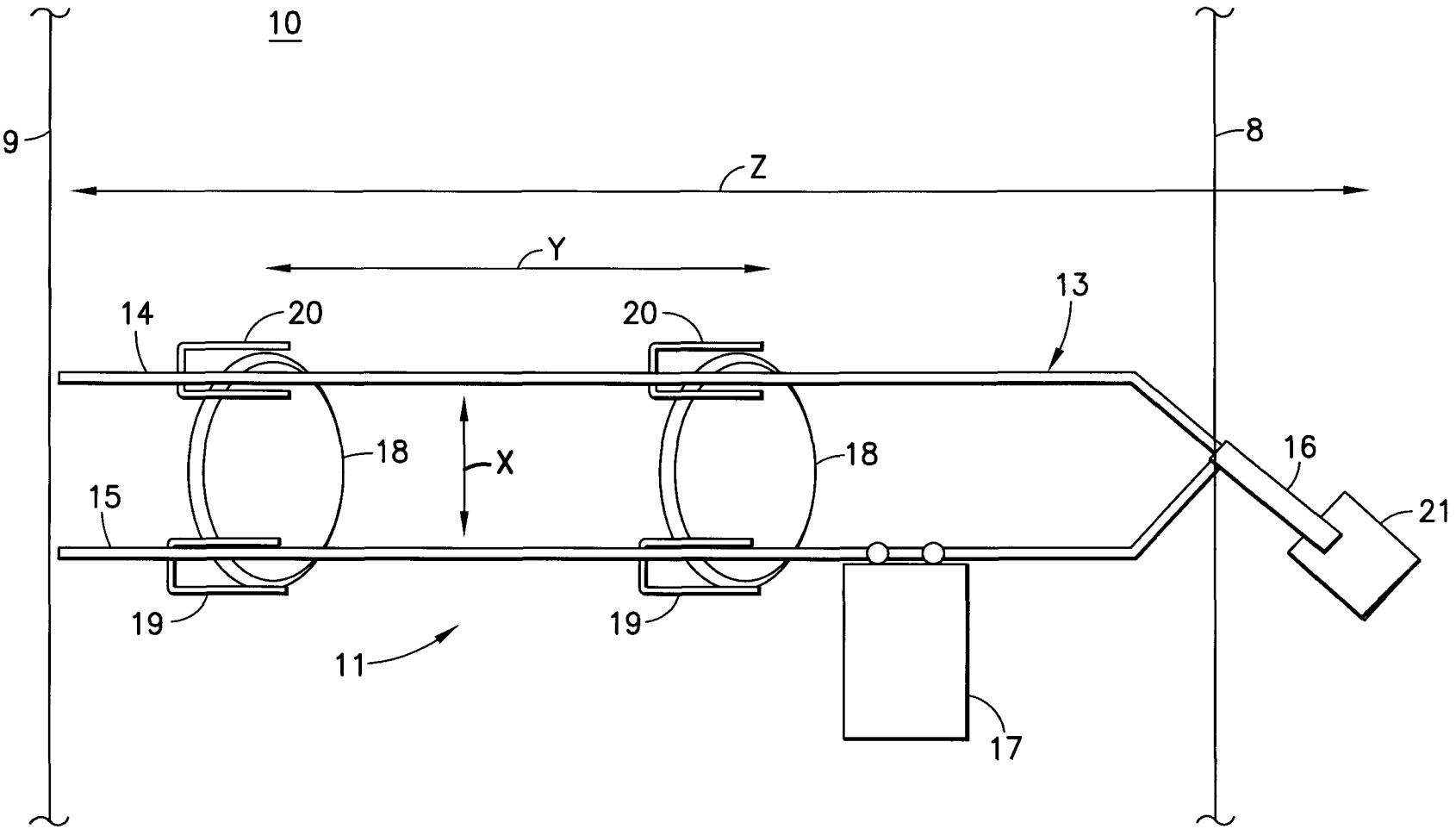
FIG. 1 is a schematic diagram of an improvised explosive device having a crush wire initiation system.

In an exemplary embodiment of the present invention, as shown in FIGS. 2-6, a device for defeating an improvised explosive device 11 (FIG. 1) having a wire initiation system 13 (FIG. 1) includes a lightweight removal member that is suitable for ground contact with a relatively shallow furrowing action, such as barbed wire assembly 21, and a connecting member 31 connecting the barbed wire assembly 21 to a support, such as a mounting member 41 (FIGS. 2-6) or a mounting member 141 (FIGS. 7-11). The connecting member 31 is disposed such that the barbed wire assembly 21 contacts the ground 91 with a dragging action that cuts shallow furrows in the surface as it passes. This shallow furrowing action of the barbed wire assembly across the ground 91 engages a wire 14 or 15 (FIG. 1) of the wire initiation system 13 (FIG. 1) and lifts it from concealment while also retaining the initiation system out from under the wheels of the vehicle. Further forward movement may also pull the blasting cap out of the associated IED device thereby defeating the improvised explosive device 11 (FIG. 1) and preserving the systems for later inspection.

Figure 4:
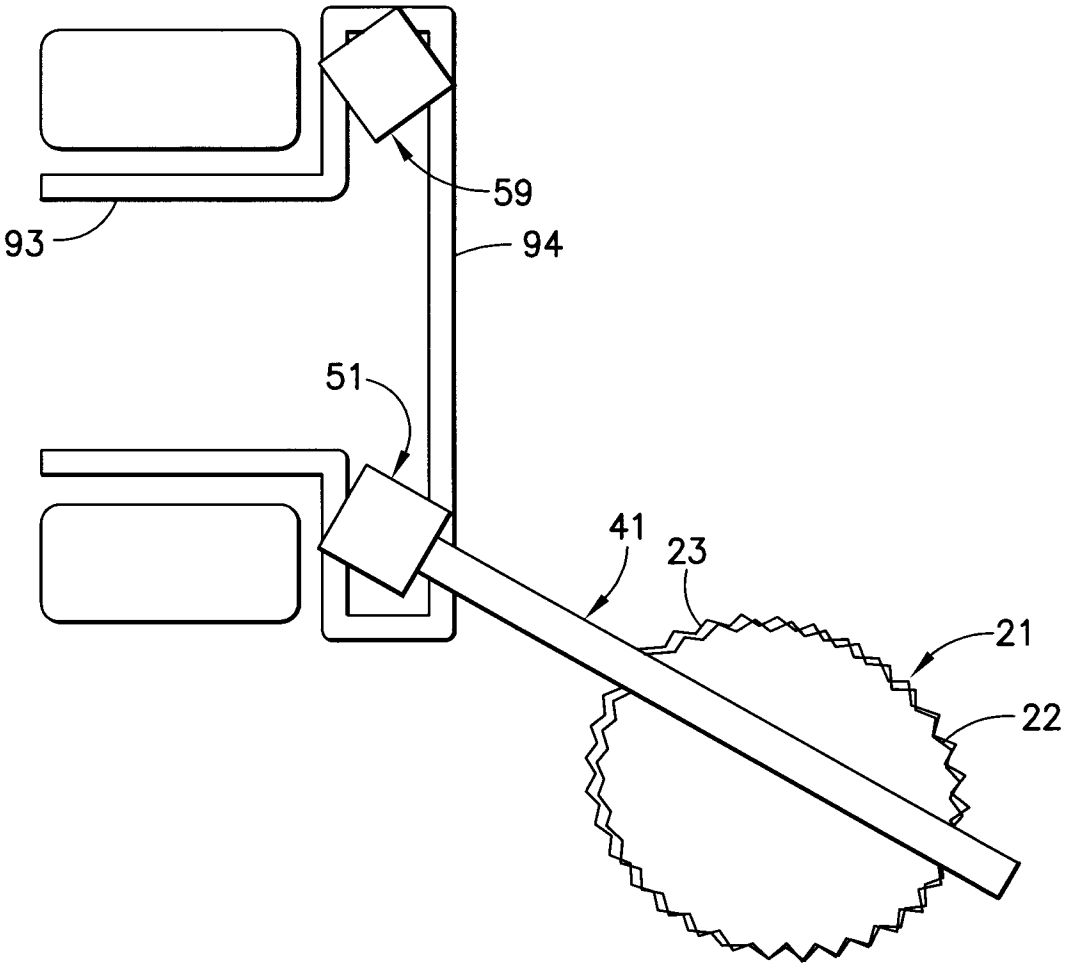
FIG. 4 is a top plan view of a defeat device including the hinge assembly and mounting member of FIG. 2 connected to a vehicle.
Figure 10:
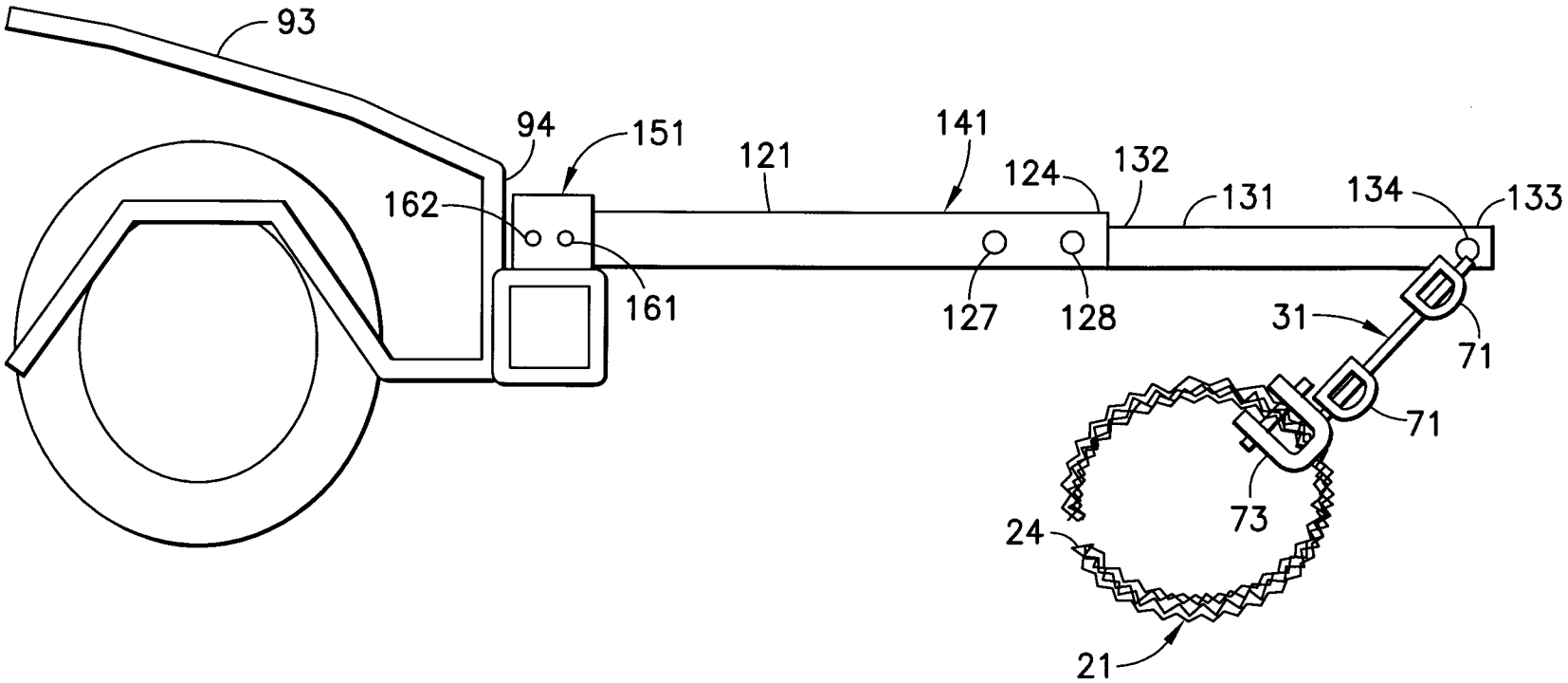
FIG. 10 is a side elevational view of the defeat device of FIG. 9.

The barbed wire assembly 21 includes a coil 22 of barbed wire 23, as shown in FIG. 4. Preferably, six coils 22 of concertina wire are used to form the barbed wire assembly 21. As shown in FIG. 10, a cut 24 can be made in the barbed wire at a trailing edge of the barbed wire assembly 23 to substantially prevent snagging as the barbed wire assembly 21 is dragged across the ground.

Figure 5:
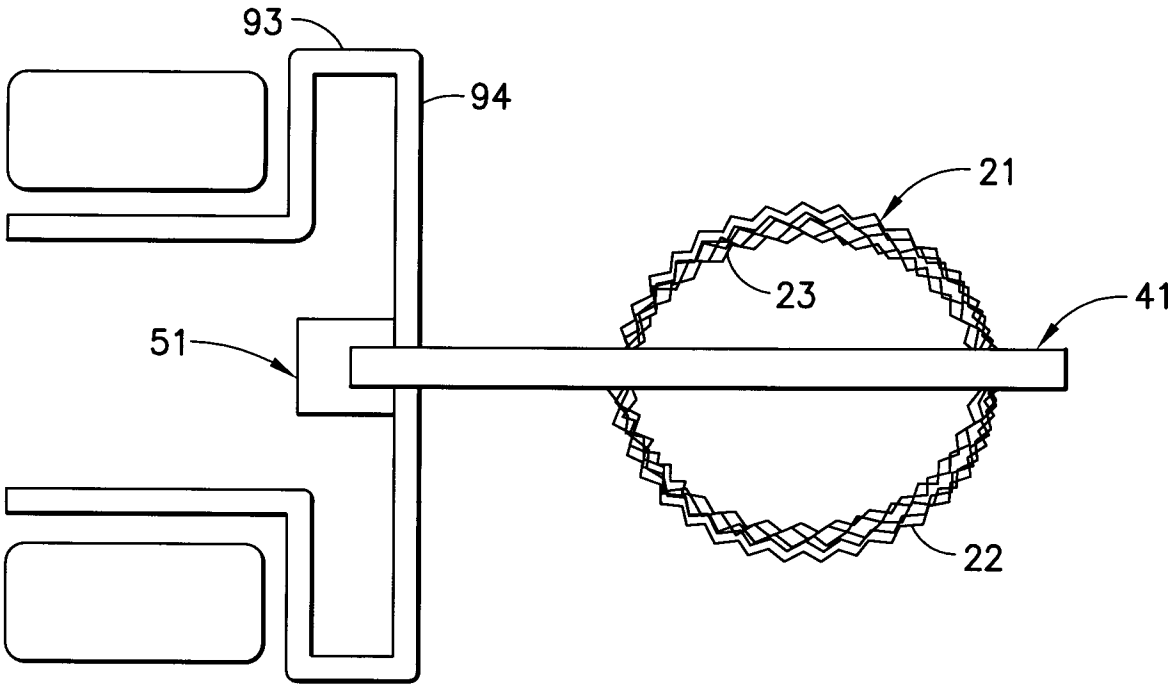
FIG. 5 is a top plan view of the defeat device of FIG. 4 connected to a vehicle in another configuration.
Figure 6:
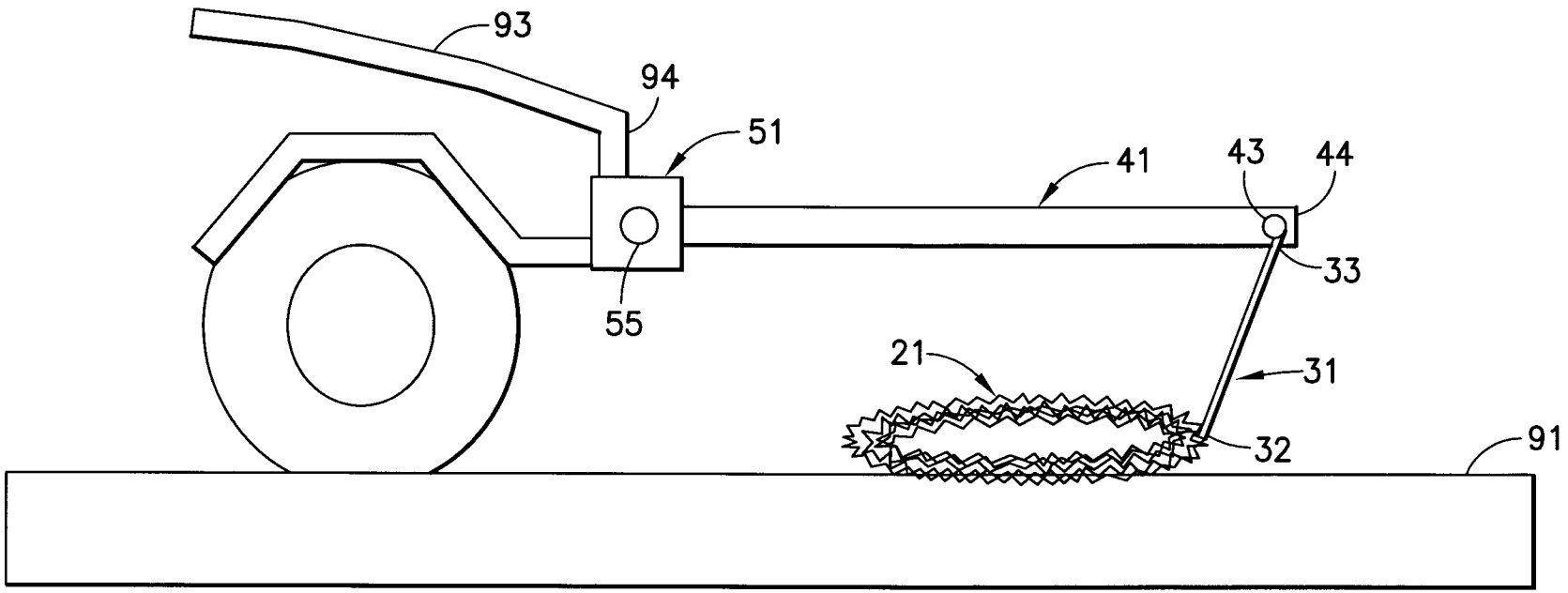
FIG. 6 is side elevational view of the defeat device of FIG. 5.

The connecting member 31 has a first end 32 and a second end 33. The first end 32 of the connecting member 31 is connected to the barbed wire assembly 21. The second end 33 of the connecting member 31 is connected to a support, as shown in FIG. 6. The support can be a mounting member 41 as shown in FIGS. 2-6, a mounting member 141 as shown in FIGS. 7-11, or any other suitable support means. Preferably, the connecting member 31 is a steel cable. Wire clamps 71 can be used to connect the first and second ends 32 and 33 of the connecting member 31 to the barbed wire assembly 21 and support, respectively, as shown in FIG. 10. The connecting member 31 is connected to the support such that the barbed wire assembly 21 contacts the ground 91, as shown in FIG. 6.

The connecting member 31 is connected to a mounting member 41, as shown in FIGS. 2-6. Preferably, the cable clamp 71 secures the connecting member 31 to the mounting member 41. The mounting member 41 has a first opening 43 disposed at a free end 44 of the mounting member. The first opening 43 receives the wire clamp 71. Alternatively, the connecting member 31 can be directly secured to the mounting member 41 using the first opening 43. A fixed end 45 of the mounting member 41 is at an opposite end from the free end 44. A second opening 47 is formed at the fixed end 45 of the mounting member 41.

When used with a vehicle 93, the mounting member 41 is preferably connected to the vehicle by a mounting bracket 51.

Figure 3:
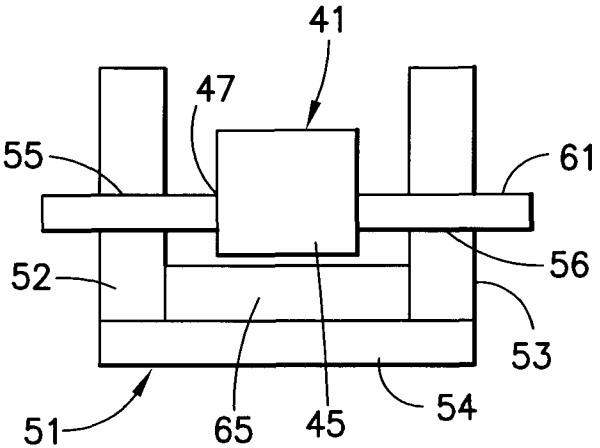
FIG. 3 is a rear elevational view of the hinge assembly and mounting member of FIG. 2.
Figure 2:
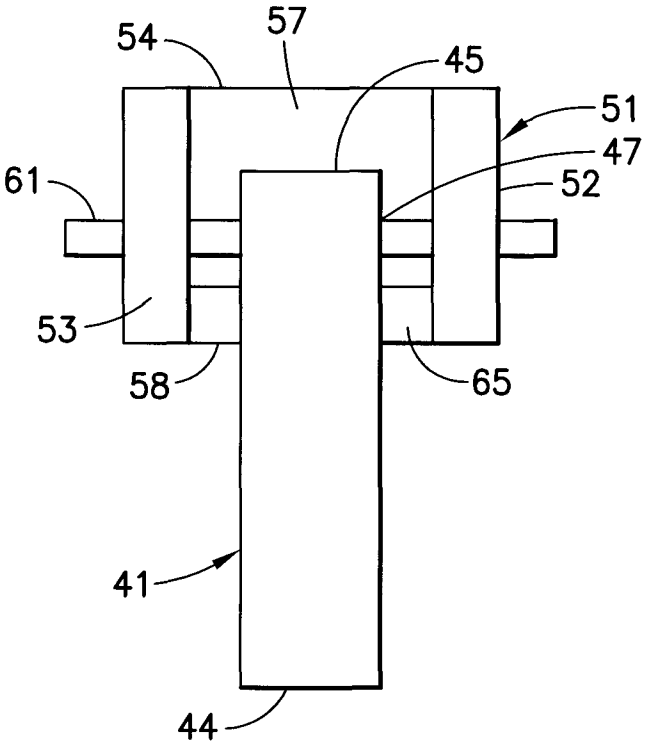
FIG. 2 is a top plan view of a hinge assembly and mounting member of a defeat device for defeating an improvised explosive device having a wire initiation system in accordance with an exemplary embodiment of the present invention.

The mounting member 41 is movable between a first or deployed position as shown in FIGS. 2, 3 and 6, and a second or raised position (not shown). When the mounting member 41 is in the first position, the barbed wire assembly 21 contacts the ground 91. When the mounting member 41 is in the second position, the barbed wire assembly 21 does not contact the ground.

The mounting bracket 51, as shown in FIGS. 2 and 3, is preferably substantially U-shaped, although any suitable shape can be used. First and second side walls 52 and 53 extend upwardly from a base member 54. First and second openings 55 and 56 are formed in the first and second side walls 52 and 53, respectively, to receive a cotter pin 61. The cotter pin 61 passes through the second opening 47 in the mounting member 41 to secure the mounting member to the mounting bracket 51. The mounting member 41 rotates about the cotter pin 61 to move between the first and second positions. A resilient pad 65 is disposed on an upper surface 57 of the base member 54. Preferably, the resilient pad 65 is disposed at a front end 58 of the base member, as shown in FIG. 2.

As shown in FIG. 4, the mounting bracket 51 can be mounted on the vehicle 93 such that the mounting member 41 is positioned at an angle with respect to a front end 94 of the vehicle 93. Preferably, a first mounting bracket 51 is mounted at a right side of the front end 94 of the vehicle 93, as shown in FIG. 4, such that the barbed wire assembly 21 contacts the ground to the side of the roadway. A second mounting bracket 59, which is substantially similar to the first mounting bracket 51, can be mounted on the left side of the front end 94 of the vehicle 93 such that the barbed wire assembly contacts the ground to the other side of the roadway. As shown in FIG. 5, the mounting bracket 51 is mounted to the front end 94 of the vehicle such that the mounting member 41 is disposed substantially perpendicularly to the front end of the vehicle and centered with respect thereto.

An alternative mounting member 141 and mounting bracket 151 are shown in FIGS. 7-11. The mounting bracket 151 is preferably substantially U-shaped, although any suitable shape can be used. First and second side walls 152 and 153 extend upwardly from a base member 154. First and second openings 155 and 156 in the first and second side walls 152 and 153, respectively, receive a first cotter pin 161. Third and fourth openings 157 and 158 in the first and second side walls 152 and 153, respectively, receive a second cotter pin 162. The first and second cotter pins 161 and 162 secure the mounting member 141 to the mounting bracket 151.

Figure 9:
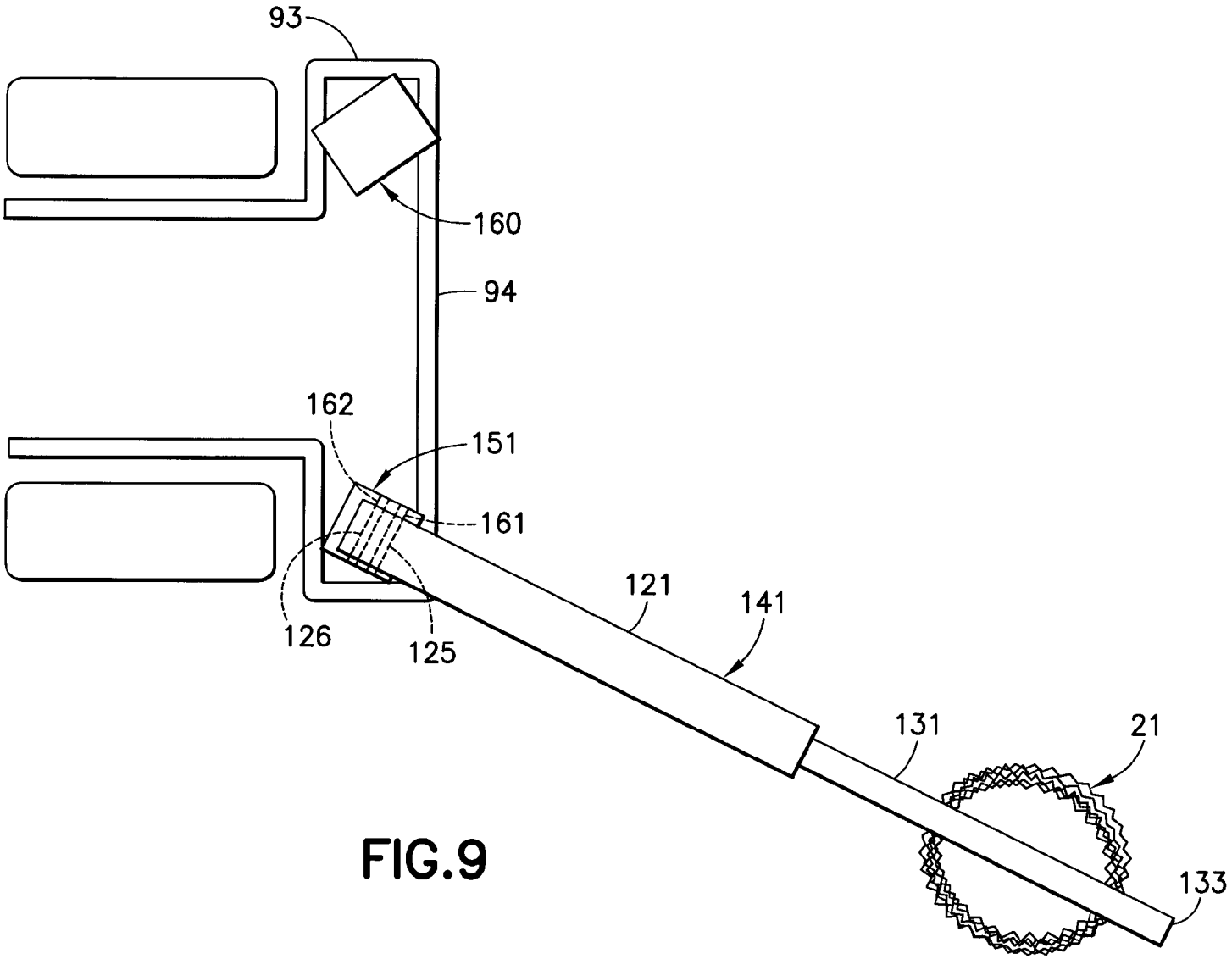
FIG. 9 is a top plan view of a defeat device including the hinge assembly and mounting member of FIG. 7 connected to a vehicle.
Figure 11:
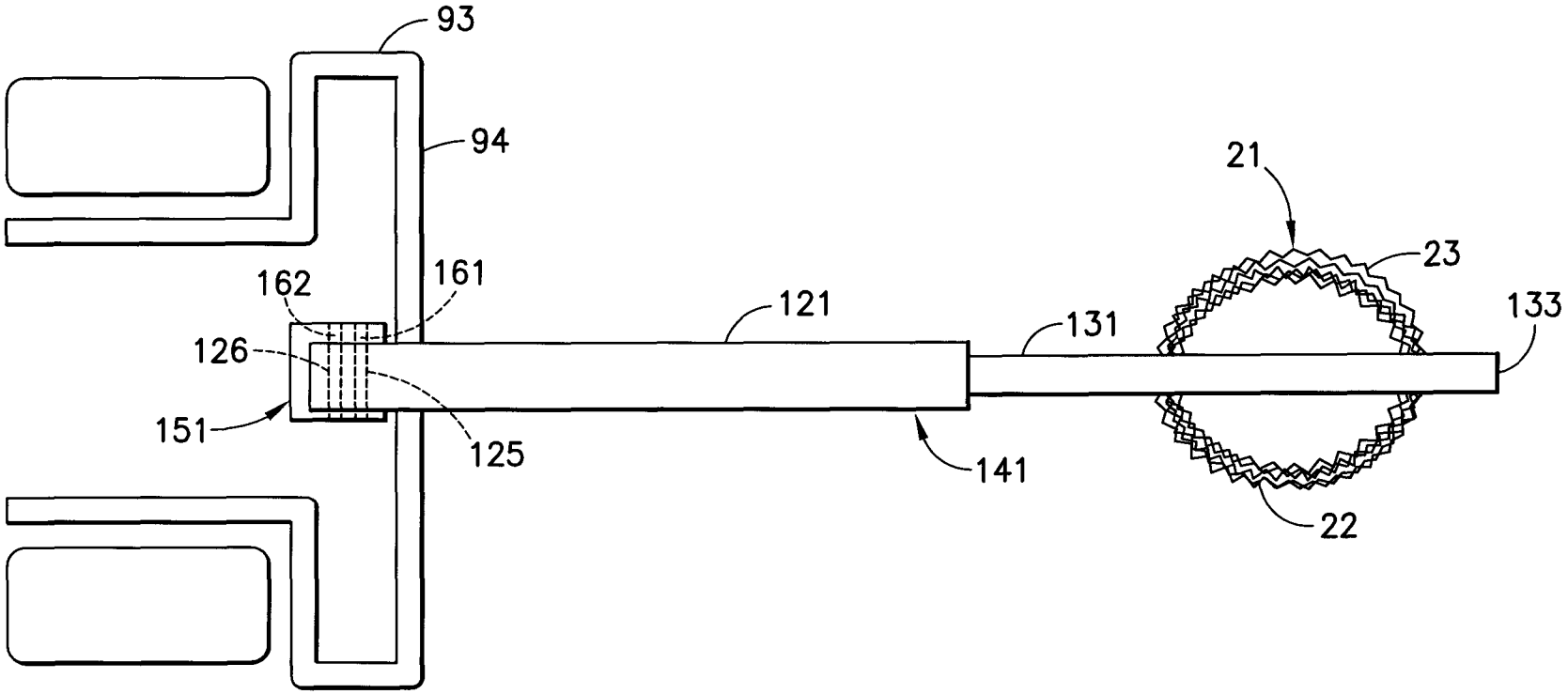
FIG. 11 is a top plan view of the defeat device of FIG. 9 connected to a vehicle in another configuration.

The mounting member 141 includes a first member 121 that receives a second member 131, as shown in FIGS. 9-11. The first member 121 has a first end 123 connected to the mounting bracket 151 and a second end 124 connected to the second member 131. A first opening 125 extending through the first member 121 receives the first cotter pin 161. A second opening 126 extending through the first member 121 receives the second cotter pin 162. The cotter pins 161 and 162 secure the first member 121 of the mounting member 141 to the mounting bracket 151. One of the cotter pins 161 and 162 can be removed to move the mounting member 141 from the first position shown in FIG. 10 to a second, or upright, position when not in use. A resilient pad 165 is disposed on an upper surface 159 of the base member 154. Preferably, the resilient pad 165 is disposed at a front end 150 of the base member 154, as shown in FIG. 10.

Figure 8:
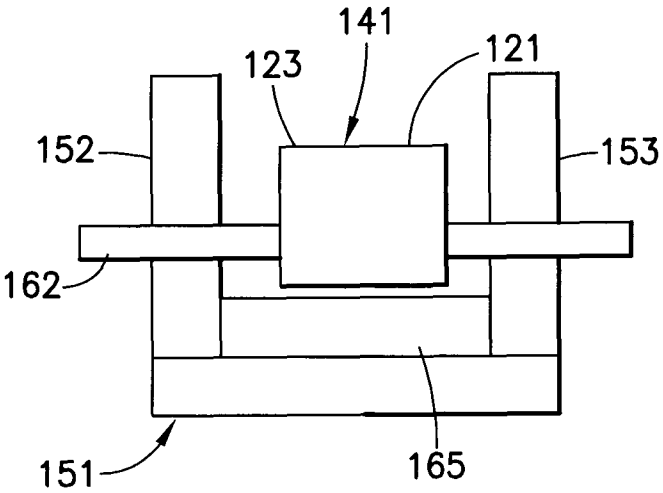
FIG. 8 is a rear elevational view of the defeat device of FIG. 7.
Figure 7:
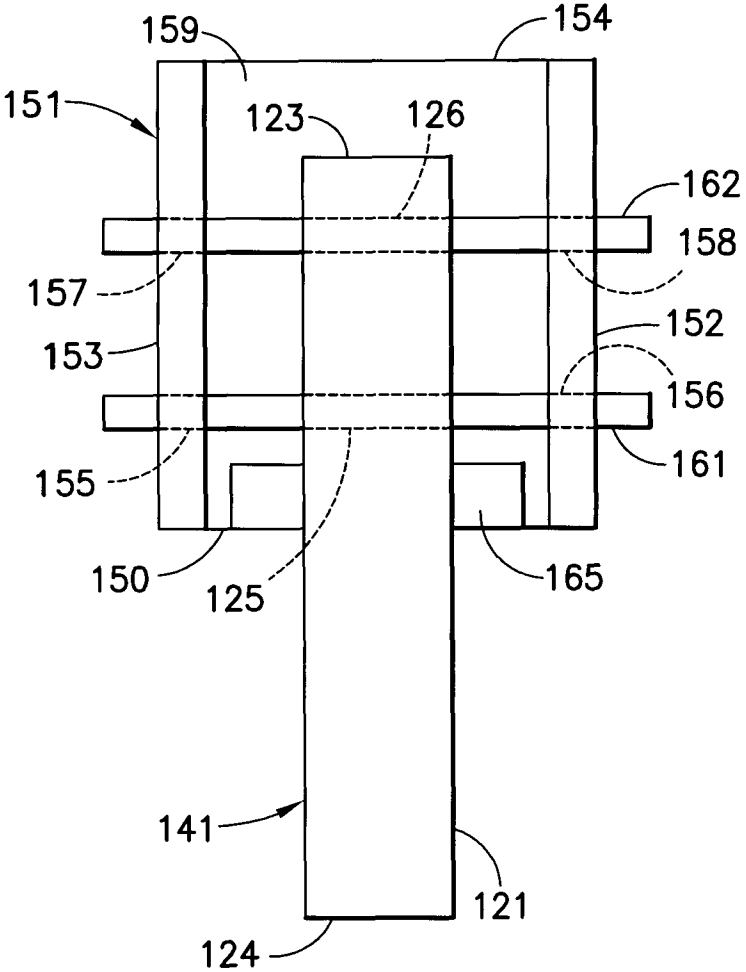
FIG. 7 is a top plan view of a hinge assembly and mounting member of a defeat device for defeating an improvised explosive device having a wire initiation system in accordance with another exemplary embodiment of the present invention.

The first member 121 preferably has a substantially rectangular shape, as shown in FIG. 8, although any suitable shape can be used. Third and fourth openings 127 and 128 are disposed proximal the second end 124 of the first member 121, as shown in FIG. 10.

The second member 131 has a first end 132 and a second end 133, as shown in FIG. 10. Preferably, the first member 121 is hollow to facilitate receiving the second member 131, has preferably has a shape corresponding to that of the first member 131 to facilitate insertion of the first end 132 of the second member 131 into the second end 124 of the first member 121. A first opening (not shown) extending through the second member 131 is aligned with either the third or fourth opening 127 and 128 in the first member 121, and a cotter pin is inserted through the aligned openings to secure the second member to the first member. The third opening 127 in the first member 121 is used to provide a shorter length for the mounting member 141 compared to using the fourth opening 128. Additional openings can be formed in the first member to provide more options for the length of the mounting member 141. A second opening 134 (similar to the first opening in the second member 131) proximal the second end 133 receives the connecting member 31.

As shown in FIG. 9, the mounting bracket 151 can be mounted on the vehicle 93 such that the mounting member 141 is positioned at an angle with respect to a front end 94 of the vehicle 93. Preferably, a first mounting bracket 151 is mounted at a right side of the front end 94 of the vehicle 93, as shown in FIG. 9, such that the barbed wire assembly 21 contacts the ground to the side of the roadway. A second mounting bracket 160, which is substantially similar to the first mounting bracket 151, can be mounted on the left side of the front end 94 of the vehicle 93 such that the barbed wire assembly 21 contacts the ground to the other side of the roadway. As shown in FIG. 10, the mounting bracket 151 is mounted to the front end 94 of the vehicle such that the mounting member 141 is disposed substantially perpendicularly to the front end of the vehicle and centered with respect thereto.

Assembly and Operation

Figure 12:
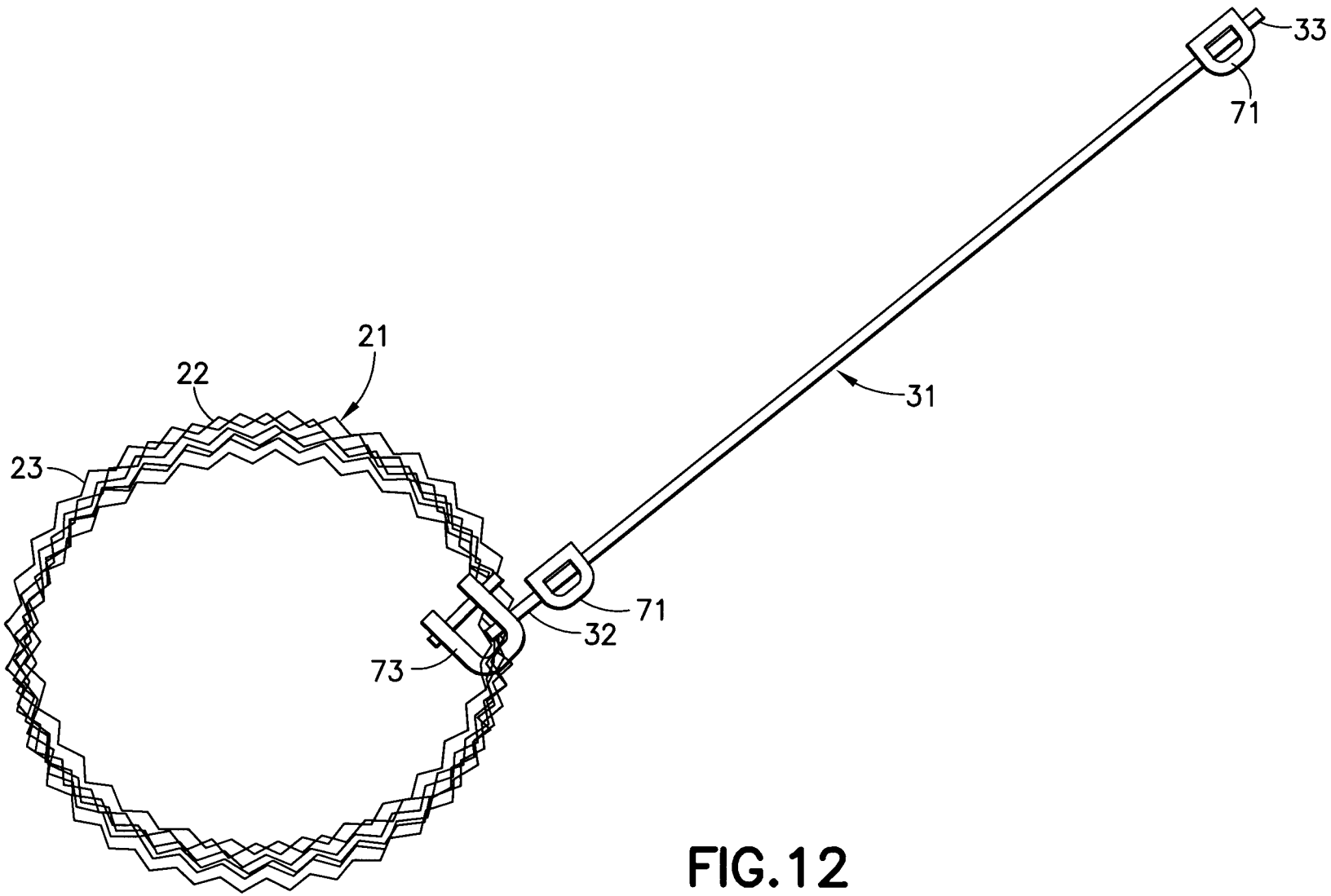
FIG. 12 is a top plan view of a barbed wire assembly and connecting member of the defeat device of FIG. 10.
Figure 13:
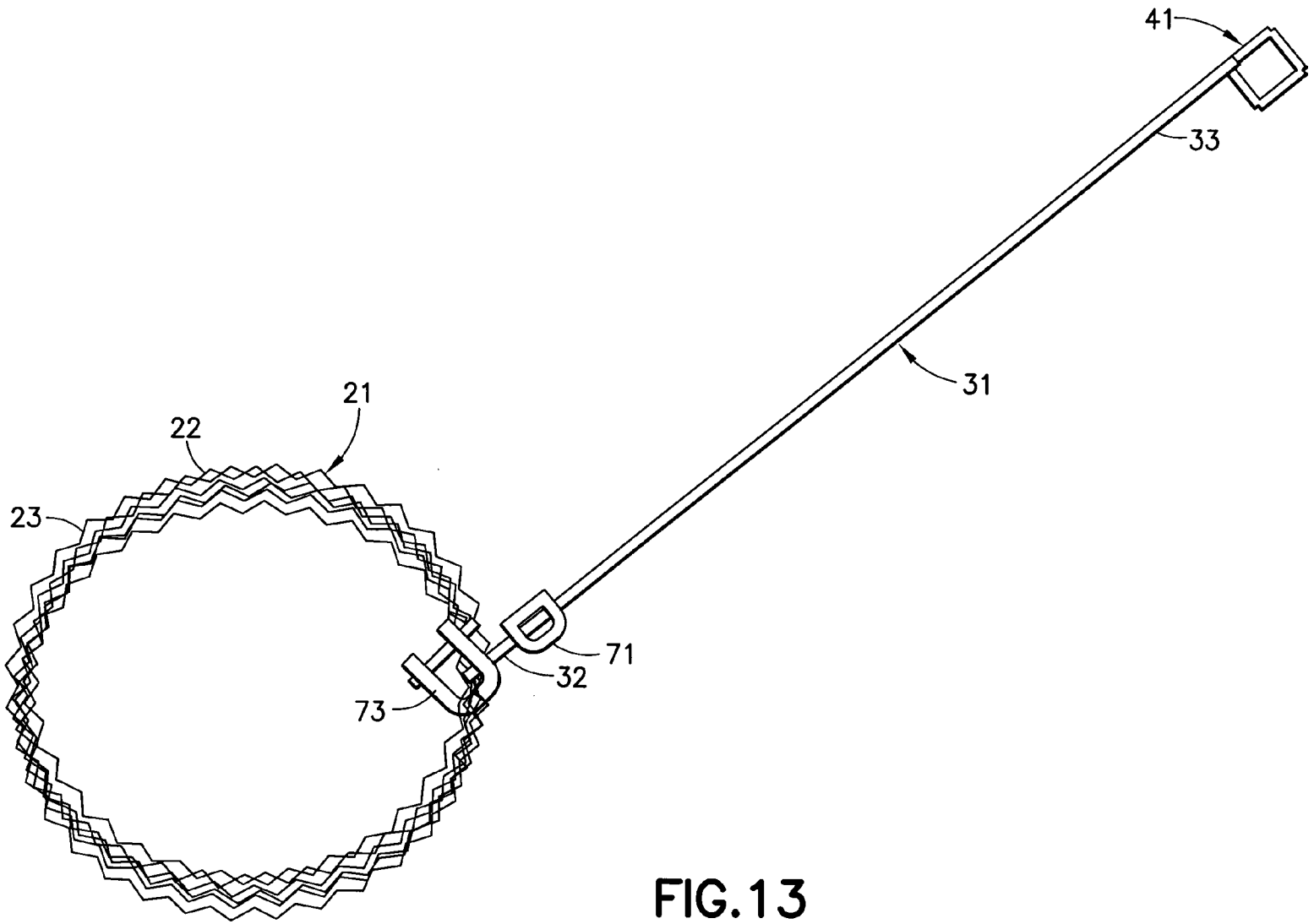
FIG. 13 is a top plan view of the barbed wire assembly and connecting member of the defeat device of FIG. 6.

The defeat device of FIGS. 2-6 includes the barbed wire assembly 21 and the connecting member 31. The connecting member 31 and the barbed wire assembly 21 are connected in any suitable manner, such as with a wire clamp 71, as shown in FIGS. 12 and 13. To facilitate contact with the ground, a weight 73 can be connected to either the barbed wire assembly 21 or the connecting member 31. The weight increases the weight of the barbed wire assembly 21 and the connecting member 31, thereby increasing contact of the barbed wire assembly 21 with the ground. Any suitable weight can be connected, such as a shackle. Additionally, a light can be connected to the barbed wire assembly 21 or the connecting member 31 to increase visibility.

The barbed wire 23 is preferably concertina wire. Preferably, six coils 22 of concertina wire are used. A cut 24, as shown in FIG. 10, can be made in the trailing edge of the barbed wire 23 to prevent snagging as the barbed wire is moved across the ground.

Some vehicles have the mounting member 41 preinstalled. The connecting member 31 can then be directly connected to the mounting member 41 as shown in FIG. 12, or be connected by a wire clamp 71 as shown in FIG. 12.

Alternatively, the mounting bracket 51 can be connected to the vehicle 93 in any suitable manner, such as by fasteners. The first opening 47 in mounting member 41 is aligned with the openings 55 and 56 in the mounting bracket 51, and then a cotter pin or any other suitable connector is inserted through the openings to secure the mounting member 41 to the mounting bracket. The connecting member 31 can then be directly connected to the mounting member 41 as shown in FIG. 12, or be connected by a wire clamp 71 as shown in FIG. 12. The resilient pad 65 is disposed on the upper surface 57 of the base member 54 of the mounting bracket 51 to absorb shocks during use and to substantially prevent damage to the mounting bracket 51 and mounting member 41, thereby prolonging their service life.

The mounting bracket 151 is connected to vehicle 93 in any suitable manner, such as with fasteners. The first member 121 of the mounting member 141 is connected to the mounting bracket 151 by aligning the openings such that the first and second cotter pins 161 and 162, or other suitable connector, can be passed therethrough. The second member 131 is inserted in the second end 124 of the first member 121, as shown in FIG. 10, such that the first opening in the second member is aligned with either the third opening 127 or the fourth opening 128 in the first member 121 depending on the desired length of the mounting member 141. The resilient pad 165 is disposed on the upper surface 159 of the base member 154 of the mounting bracket 151 to absorb shocks during use and to substantially prevent damage to the mounting bracket 151 and mounting member 141, thereby prolonging their service life.

The connecting member 31 is then connected to the mounting member 41 or 141. A wire clamp 71 as shown in FIG. 12 can be used to connect the connecting member 31 to the mounting member. Alternatively, the connecting member 31 can be directly connected to the mounting member, as shown in FIG. 13. The connecting member 31 is connected such that the barbed wire assembly contacts the ground 91, as shown in FIG. 6.

The mounting bracket 51 and 151 can be connected to the front end 94 of the vehicle 93 such that the mounting member 41 and 141 extends substantially perpendicularly to the front end 94 of the vehicle 93, as shown in FIGS. 5 and 11. When connected in such a manner, the barbed wire 23 is able to engage a wire of a wire initiation system 13 stretched across a road 10, as shown in FIG. 1. The barbed wire 23 engages the initiation wire, and continued movement of the vehicle causes the initiation wire to be pulled out from the blasting cap 16. The initiation wires 14 and 15 are typically loosely connected to the blasting cap, such that the wires are easily removed by the defeat device, thereby safely defeating the IED. The IED can then be collected and studied. Additionally, by not detonating the IED, the presence of the vehicle 93 in the area is not made known. When the initiation wires 14 and 15 are more tightly packed in the blasting cap 16, then engagement by the barbed wire 23 of the defeat device pre-detonates the IED ahead of the vehicle.

The mounting bracket 51 and 151 can be connected to sides of the front end 94 of the vehicle, as shown in FIGS. 4 and 9. The mounting brackets are mounted at opposite sides of the front end 94 such that the barbed wire 23 of the defeat device sweeps the road, as opposed to the side of the road where the vehicle is travelling. Alternative mounting brackets 59 and 160 allow the mounting member to be connected to either side as desired.

The barbed wire 23 needs to be replaced after prolonged use as the contact with the ground deteriorates the barbs. The connecting member 31 can be quickly disconnected and a new connecting member 31 and barbed wire assembly 21 connected. Accordingly, the new connecting member and barbed wire assembly is quickly installed without requiring extensive downtime and manpower. Additionally, the defeat device according to the exemplary embodiments of the present invention is inexpensive to manufacture and replace.

The foregoing embodiments and advantages are merely exemplary and are not to be construed as limiting the scope of the present invention. The description of exemplary embodiments of the present invention is intended to be illustrative, and not to limit the scope of the present invention. Various modifications, alternatives and variations will be apparent to those of ordinary skill in the art, and are intended to fall within the scope of the invention as defined in the appended claims and their equivalents.

What is claimed is:

1. A vehicle-mounted, IED defeat device for detecting, disarming and otherwise defeating detonation of an improvised explosive device, said device comprising:

a lightweight removal member that is suitable for ground contact;

an adjustable mounting member adapted to be secured to a support, said mounting member including a second member adjustably secured to a first member, said second member being adjustable to adjust a length of said mounting member; and a connecting member connecting said removal member to said mounting member, said connecting member being disposed such that said removal member drags against the ground with a furrowing action, wherein the furrowing action of said removal member against the ground engages and retains said improvised explosive device away from tires of said vehicle.

2. The defeat device according to claim 1 wherein said removal member comprises barbed wire.

3. The defeat device according to claim 2, wherein said barbed wire comprises concertina wire.

4. The defeat device according to claim 1, wherein at least one weight is connected to said at least one coil of said barbed wire or to said connecting member to facilitate maintaining contact of said at least one coil of said barbed wire with the ground.

5. The defeat device according to claim 1, wherein said connecting member is a steel cable.

6. The defeat device according to claim 5, wherein a first cable clamp secures said cable to the support and a second cable clamp secures said cable to said at least one coil of said barbed wire.

7. The defeat device according to claim 1, wherein said at least one coil of said barbed wire is cut at a trailing edge to prevent snagging said at least one coil of said barbed wire when being moved over the ground.

8. The defeat device according to claim 1, wherein a mounting bracket secures said mounting member to the vehicle.

9. The defeat device according to claim 8, wherein a cotter pin connects said mounting member to said bracket.

10. The defeat device according to claim 8, wherein a resilient pad is connected to said bracket to absorb movement of said mounting member.

11. The defeat device according to claim 8, wherein said connecting member is a steel cable.

12. The defeat device according to claim 11, wherein a first cable clamp secures said cable to said bracket and a second cable clamp secures said cable to said at least one coil of said barbed wire.

13. The defeat device according to claim 1, wherein said improvised explosive device comprises a crush wire initiation system.

14. A device for defeating improvised explosive devices, comprising:

a mounting member adapted to be secured to a vehicle, said mounting member including a second member adjustably secured to a first member, said second member being adjustable to adjust a length of said mounting member;

a barbed wire; and a connecting member connecting said barbed wire to said mounting member, said connecting member being disposed such that said barbed wire is disposed on the ground.

15. The defeat device according to claim 14, wherein said barbed wire is concertina wire.

16. The defeat device according to claim 15, wherein at least one weight is connected to said barbed wire to facilitate maintaining contact of said barbed wire with the ground.

17. The defeat device according to claim 14, wherein said barbed wire is cut at a trailing edge to prevent snagging said barbed wire when being moved over the ground.

18. The defeat device according to claim 14, wherein said improvised explosive device comprises a crush wire initiation system.

19. A device for defeating improvised explosive devices using wire initiation systems, comprising:

a mounting member adapted to be secured to a vehicle, said mounting member including a second member adjustably secured to a first member, said second member being adjustable to adjust a length of said mounting member;

a barbed member; and a connecting member connecting said barbed member to said mounting member, said connecting member being disposed such that said barbed member is disposed on the ground.

20. The defeat device according to claim 19, wherein said barbed member is a barbed wire.

21. The defeat device according to claim 20, wherein said barbed wire is a concertina wire.

22. The defeat device according to claim 19, wherein at least one weight is connected to said barbed member to facilitate maintaining contact of said barbed member with the ground.

* * * * *